United States Patent [19]

Opsvik

[11] Patent Number: 4,960,305

[45] Date of Patent: Oct. 2, 1990

[54] AIR COMPRISING SUPPORTS FOR THE POSTERIOR AND THE SHINS, RESPECTIVELY, OF A CHAIR OCCUPANT

[76] Inventor: Peter Opsvik, Hogtunveien 12, 1370 Asker, Norway

[21] Appl. No.: 131,374

[22] Filed: Dec. 10, 1987

Related U.S. Application Data

[63] Continuation-in-part of Ser. No. 869,834, May 23, 1986, Pat. No. 4,767,159, which is a continuation of Ser. No. 675,837, filed as PCT No84/00014 on Mar. 15, 1984, published as WO84/03614 on Sep. 27, 1984, abandoned.

[30] Foreign Application Priority Data

Mar. 17, 1983 [DE] Fed. Rep. of Germany ..... 307879
May 4, 1983 [DE] Fed. Rep. of Germany ..... 313203

[51] Int. Cl.[5] ..... A47C 7/50

[52] U.S. Cl. ..... 297/423; 297/437; 403/108

[58] Field of Search ..... 297/423, 437, 195, 429, 297/431, 353; 248/188.7, 157; 403/109, 106, 108, 378, 377

[56] References Cited

U.S. PATENT DOCUMENTS

| | | | |
|---|---|---|---|
| 1,065,022 | 6/1913 | Bell | 297/195 X |
| 2,177,174 | 10/1939 | Eccles | 297/437 |
| 2,308,358 | 1/1943 | Cramer | 297/437 |
| 2,521,422 | 9/1950 | Strand | 297/149 X |
| 2,554,490 | 5/1951 | Eames | 297/306 |
| 2,844,187 | 7/1958 | Scoville | 297/429 X |
| 3,008,764 | 11/1961 | Pile | 297/306 |
| 3,669,493 | 6/1972 | Vowles | 297/423 X |
| 3,891,270 | 6/1975 | Crossman et al. | 297/347 |
| 4,190,377 | 2/1980 | Pleuss | 403/108 |
| 4,238,097 | 12/1980 | Clausen et al. | 297/423 X |
| 4,328,991 | 5/1982 | Mengshoel et al. | 297/423 X |
| 4,373,756 | 2/1983 | Purdy et al. | 297/149 X |
| 4,377,309 | 3/1983 | Mengshoel | 297/423 |
| 4,427,234 | 1/1984 | Peters | 297/437 X |
| 4,650,249 | 3/1987 | Serber | 297/423 X |
| 4,767,159 | 8/1988 | Opsuik | 297/423 |

FOREIGN PATENT DOCUMENTS

| | | | |
|---|---|---|---|
| 0018812 | 11/1980 | European Pat. Off. | 297/172 |
| 273237 | 10/1913 | Fed. Rep. of Germany | 297/423 |
| 2727408 | 1/1979 | Fed. Rep. of Germany | 297/423 |
| 3024920 | 1/1982 | Fed. Rep. of Germany | 297/423 |
| 3246088 | 6/1984 | Fed. Rep. of Germany | 297/423 |
| 1131618 | 2/1957 | France | 297/423 |
| 379713 | 8/1964 | Switzerland | 297/172 |
| 1239729 | 7/1971 | United Kingdom | 297/347 |
| 8500275 | 1/1985 | World Int. Prop. O. | 297/423 |

*Primary Examiner*—Laurie K. Crammer
*Attorney, Agent, or Firm*—Darby & Darby

[57] ABSTRACT

A swivel stool or chair adapted to support a person so that the person's weight is distributed between the posterior and the shins in a kneeling-like position, the stool combines a base member from which there extends upwardly a substantially vertical supporting column adjustable in vertical supporting column adjustable in vertical direction, a substantially flat preferably slanting seat support being arranged at a first level at the top area of said supporting column for supporting the posterior of a stool user and a substantially flat shin support is spaced from and disposed at a second level below and forward of said seat support and preferably slanting in the opposite direction thereof. The seat support and the shin support are interconnected by an interconnecting means which is rotatably mounted to said vertical supporting column, thereby allowing simultaneous rotation of said seat and shin supports, as well as simultaneous vertical adjustment of said sheat and shin supports relative to said supporting column, whilst at the same time allowing for said spaced relationship between the seat and shin support. In a special embodiment the interconnection means might comprise means for adjusting the distance between said seat and shin supports.

19 Claims, 18 Drawing Sheets

30a
102
152a
103
151a
155a
110a
113
123
100
101
151b
152b 30a
153
151
102
α1
160
109
103
100
155a
156a
G1
β1
154
β2
110a
151a
102a
101
170
101a
103
α2
161

102
110b
101
30b
G2

30a
102
160a
160b
160c
100
101b
101c
103
106
156a
162
α3
α4
α6

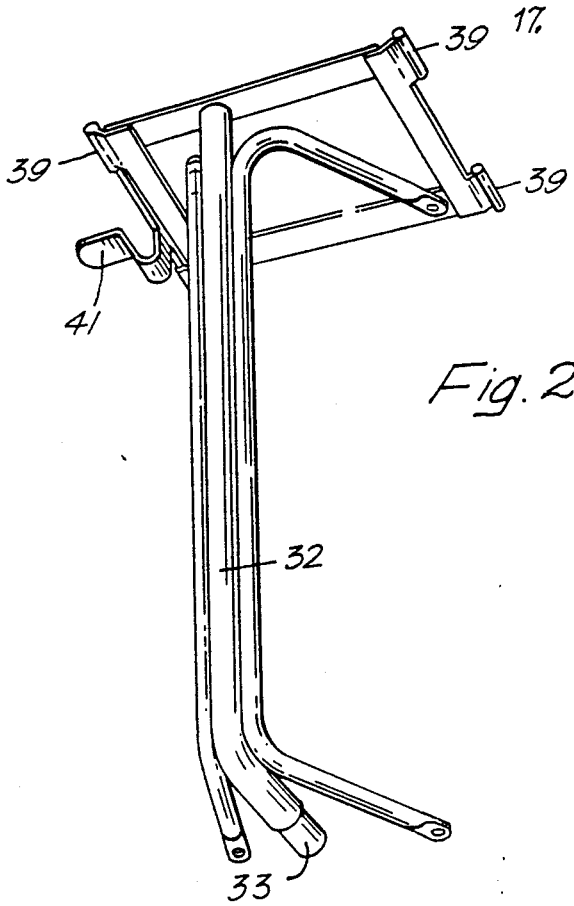
Fig. 21
Fig. 22
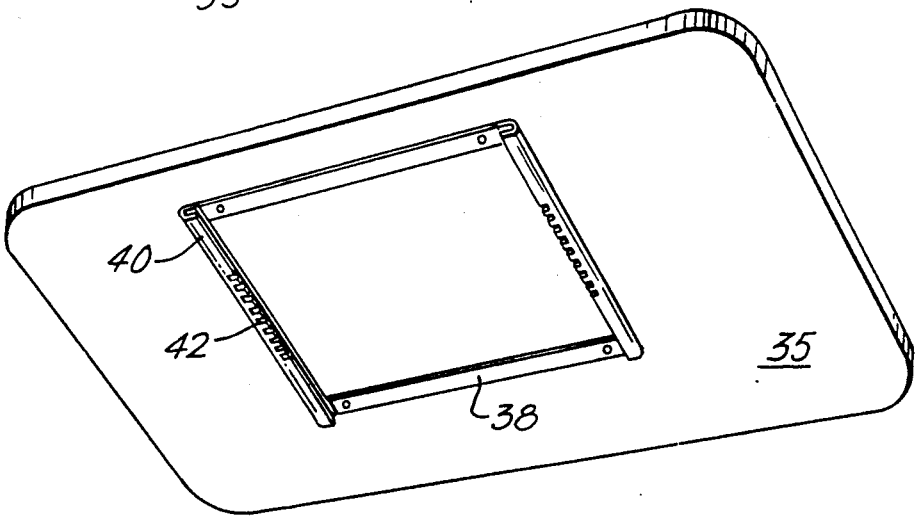

AIR COMPRISING SUPPORTS FOR THE POSTERIOR AND THE SHINS, RESPECTIVELY, OF A CHAIR OCCUPANT

RELATED PATENT APPLICATIONS

The present application is a continuation-in-part of a previous U.S. application, Ser. No. 869,834, filed May 23, 1986, Pat. No. 4,767,159, which is a continuation application of the originally filed U.S. application, Ser. No. 675,837 filed as PCT NO84/00014 on Mar. 15, 1984, published as WO84/03614 on Sep. 27, 1984, now abandoned.

FIELD OF THE INVENTION

The present invention relates to a chair adapted to support a person in a kneeling-like, sitting position, said chair comprising a seat support arranged at a first level for supporting the posterior of the chair occupant, as well as a substantially flat shin support spaced from and disposed at a second level below and forward of said seat support for supporting the distributed body weight thereon over the length of the shin.

PRIOR ART

Such a chair which allows the user to take a kneeling-like, sitting position is known iner alia from German Industrial Design MR 18743 (Peter Opsvik), and from European Patent Application no. 80,301,384,5 (Publication no. 0018812- H.C. Mengshoel).

Such chairs, which comprise a substantially flat preferably slanting seat support arranged at a first level for supporting the posterior of the chair occupant, as well as a substantially flat shin support spaced from and disposed at a second level below and forward of said seat support, and preferably slanting in the opposite direction thereof, will allow the occupant with his posterior resting on the seat support to distribute the body weight by resting the shins of his legs on said shin support for thereby spreading the distributed body weight thereon over the length of the shin, for thereby taking a natural posture of balance with a substantially vertical position of the torso.

However, these known posterior and shin supporting chairs are not versatile as regards the use thereof, for example as an office chair, for which chair it is required that the table top of an office desk, or alternatively in relation to the top level of a drawing table.

Besides, the known posterior and shin supporting chairs do not allow for a rotation of the upper part of the chair, let alone any easy and friction-less movement of the chair whilst the occupant is resting in his posterior and shin supporting position.

Finally, the above known posterior and shin supporting chairs do not allow for an adjustment between the seat support, and the shin support so as to adjust for various sizes of individual users.

From U.S. Patent Specification 1,065,022 (H.M. Bell) there is known a supporting device which enables a person to be fitted by a tailor or dressmaker to stand in exactly the same posture for long periods, without suffering discomfort.

It is true that U.S. Patent Specification 1,065,022 teaches a way of supporting the posterior of a dressmaker's or tailor's client, but the posterior support is more or less like a saddle which would not give any comfortable support for sitting purposes. Further, U.S. Patent Specification 1,065,022 provides two knee-engaging pads which allow the user to have a very slightly bent leg for thereby being able to adopt a static posture which resembles that of a walking person, and of the pads where to engage the shins of the occupant they would not provide the comfortable, stable posture for which the known device is designed.

It is also true that the knee-engaging pads as well as the saddle-like posterior support can be adjusted to accommodate different sizes of a user of the supporting device, but since the user will have her or his feet on a stand portion which is at a permanent level above floor level, the arrangement as a whole will not allow for any sitting kneeling-like position at various heights relative to the top level of for example a drawing desk. Thus, the supporting device according to U.S. Patent Specification 1,065,022 is made to allow the user to take a very erect posture, which of course must be so in order for any dressmaking adjustments and measurements to be effective. A dress or a suit would normallY be designed to be worn by the wearer when standing and/or walking, and although it should be possible for the wearer to be able to sit comfortably in the dress or suit, it is not the traditional method of tailoring or dressmaking to make the final adjustments to the garment when the wearer is seated. Otherwise, when the wearer is standing with the same garment on, there will be undesirable creases and wrinkles in the garment which would make it very unattractive and unacceptable.

From U.S. Patent Specification 3.891.270 (Crossman et al) there is known a pneumatic stool with a foot rest connected to a seat base, this foot rest taking the shape of a foot supporting bar which allows the user of the seat to sit on the chair portion and, with knees bent to varying degrees, resting the base of the foot, but not the shin, on the foot rest below said seat. However, this type of foot rest onto which the heels of the user is to be placed during use of the chair or stool, will not allow for the type of kneeling-like sitting posture explained in the preamble. According to U.S. Patent Specification 3,891,270 there is no hint of a substantially flat shin support spaced from and disposed at a lower level below and forward of said seat support and preferably slanting in the opposite direction thereof, so as to cooperate with a substantially flat and preferably slanting seat support arranged at a higher level, and so as to allow the user to let his posterior rest on the seat support with an open angle between torso and thighs, whilst simultaneously resting his shins of his legs on said shin support for thereby spreading the distributed body weight thereon over the length of the shin, for thereby taking a natural posture of balance with a substantially vertical position of the torso. It should in this connection be noted that the load of the lower leg must always be spread over the length of the shins, and not the knees, and that the support of the posterior must always be such that no matter what the angle of inclination of the thighs there will always be a substantially vertical posture of the torso.

If the stool according to U.S. Patent Specification 391,270 should be used to obtain a balanced posture whilst using the foot rest as a shin support, it would involve a dangerous and difficult maneouvre, which would be necessary if a user should try to employ the foot rest sas a shin support. In this connection it should be born in mind that only front entry os possible for the legs of the user, and that somehow the osterior of the user must be balanced on the front edge of the stool while the feet are being threaded through the support bar.

Accordingly, the stool suggested in U.S. Patent Specification 3,891,270 will give a dangerous posture of the user in case he is to use this known stool for a kneeling-like sitting position, since he is at great risk of falling forwards from the stool, or even topling together with the stool, whilst furthermore needing to use both hands in order to balance the posterior precariously on the front edge of the stool seat.

Although the stool seat and the foot rest according to U.S. Patent Specification 3,891,270 can be lowered or lifted at the same time, the relation between the stool seat and the heel support will not accommodate for a kneeling-like posture, as explained above, and the fact that the foot rest is not moveable relative to the seat is not by design, but is by way of economic expediency in that the easiest way of accommodating many different body lengths resides in varying the bend at the knee of the user. Further, U.S. Patent Specification 3.891.270 does not indicate any adjustment of the foot rest, which could be included in the design of the present chair encompassing combined posterior and shin supports.

From U.S. Patent Specification 3,669,493 (Vowles) there is known a chair adapted to support a person so that his weight is distributed between his posterior and his knees. The chair includes a knee support and a seat support sloping generally downwards towards the knee support, the sloping seat and knee support co-operating to shift a portion of the person's weight on to the knee support, so that the weight born by the person's posterior is reduced.

It should here again be noted that according to the above definition of a kneeling-like sitting position, the load on the lower leg must always be spread over the length of the shins, and not on the knees, an expedient which can be implemented if the seat support is inclined form zero degrees to twenty degrees relative to a first horizontal level, whereas the shin support is inclined form zero degrees to forty-five degrees relative to a second horizontal level, said inclinations being opposite to each other. According to U.S. Patent Specification 3,669,493 the inclination of the knee support will be from approximately vertical to an angle of about thirty degrees to the vertical, the knee support also extending its surface upwardly into the prolonged level of the seat support. This relative position of the seat support and the knee support according to U.S. Patent Specification 3,669,493 will definitely give a knee supporting rather than a shin supporting position for the user of the chair, a kneeling-like shin supporting balanced position which the user can take when using a chair of the present type, and in which the user can extend his feet substantially freely behind the shin supports, rather than being limited by an arcuate foot rest. Besides, U.S. Patent Specification 3,669,493 does not allow for a simultaneous adjustment of the height relative to a common supporting column for a seat and a shin support, let alone indicating that the known chair should be provided with roller means or the like for readily displacement on the floor along a drawing desk or an office desk, the rolling of the known chair, when the user is in his sitting position, being prohibited by the arcuate foot-rest.

BRIEF DISCUSSION OF THE INVENTION

An object of the invention is to provide a chair which can easily be adjusted as regards level so as to be used for persons of different sizes sitting in front of working desks or office desks located at various levels above the floor.

Another object of the present invention is to provide a chair which requires a minimum of space and can be easily displaced on a floor.

Yet another object of the invention is to provide a chair having supporting members for the posterior and the shins, which allows for common rotation of said supports, at the same time as the common rotational movement can be combined with a simultaneous vertical lifting or lowering of said supports.

Still another object of the present invention is to provide a chair of the type having supporting members for the posterior and the shins, comprising means for adjusting the distance between said supports, so as to allow for a pre- adjustment of the spatial relation therebetween, and for later simultaneous adjustment of the height thereof relative to a supporting column included in the chair.

A further object of the present invention is to provide a chair of the mentioned type for a kneeling-like posterior and shin supporting posture, in which the adjustment means between the shin support and the seat support comprises easily operable elements for thereby facilitating said adjustment.

The above objects are achieved in a swivel stool, comprising in combination, a base member, a substantially vertical supporting column extending upwardly from said base member, a substantially flat preferably slanting seat support arranged at a first level at the top area of said column for supporting the posterior of a stool user, a substantially flat shin support spaced from and disposed at a second level below and forward of said seat support, and preferably slanting in the opposite direction thereof, means for interconnecting said seat support and shin support to allow for said spaced relationship, so that the user with his posterior resting on the seat support can distribute the body weight acting downwardly thereon by resting the shins of his legs on said shin support spreading the distributed body weight thereon over the length of his shin, for thereby taking a natural posture of balance with a substantially vertical position of the torso, means for simultaneously adjusting the weight relative to said supporting column of said seat and shin supports for the unison height adjustment thereof.

The posture of the user afforded by the present chair, as explained above, is particularly acceptable, both ergonomically and therepeutically, said posture therefore being superior to the more functional supports required in U.S. Patent Specification 1,065,022 affording for the standing posture for dressmaking and/or tailoring, and U.S. Patent Specification 3,891,270 affording the sitting posture with the feet off the ground.

According to a preferred embodiment of the present chair, the seat support and shin support interconnecting means should include an elongated frame member, the frame member having a first end and a second end opposite the first end, the shin support being mounted on the frame member in proximity to the first end thereof, whereas the seat support being mounted on the frame member in proximity to the second end thereof, and said frame member being rotatably mounted to the vertical supporting column.

According to U.S. Patent Specification 1,065,022 (Bell) discussed above, the supporting device according to this publication lacks a shin support, but does provide a knee support instead, and lacks the common frame member and the rotatability thereof. Furthermore, there is no suggestion of the adjustment of the lower support being in unison with the adjustment of the saddle-like posterior support.

Also U.S. Patent Specification 3,891,270 (Crossman et al) lacks a shin support, but comprises a foot rest bar instead, and it should be noted that the totally different posture required of U.S. Patent Specification 3,891,270 and of U.S. Patent Specification 1,065,022 as compared with the present chair, is such that any differential adjustment of the posterior support and the lower support (foot rest) would be redundant.

Although U.S. Patent Specification 3,669,493 (Vowels) suggests an adjustment of the seat and knee supports to suit the particular anatomic proportions of the user, this adjustment would not allow for the user to take a kneeling-like balanced position, in which the distributed load will be spread over the length of the shins, since the knee support in every inclined position thereof, will only allow for a knee support, and an additional support of the user's feet on an arcuate, lateral foot rest. This is a due to the fact that the knee support will project above the extended plane of the seat support, and independently of where the user places his feet in contact with the arcuate-shaped foot supports, it will only permit the user to support his knees. This knee supporting position is quite different from the present kneeling-like posterior and shin supporting sitting posture offered by the present swivel stool, in which the feet of the user can be freely depending behind and below the shin support, and just by a comfortable movement by one of his legs, the user might reach the floor with his toes for thereby being able to not only shifting his kneeling-like position, but also allowing for a displacement of the roller supported chair with a minimum of effort exercised by a toe/ instep movement. This toe movement can also be used not only for displacing the present chair along the floor, but also for rotating the user whilst sitting in this kneeling-like position. Additionally, the present chair allows for a unison height adjustment of the seat and shin supports, which is not envisaged according to the teachings of U.S. Patent Specification 3,660,493.

BRIEF DESCRIPTION OF THE DRAWINGS

The invention will now be further described in the following with ref enclosed drawings.

FIG. 11*a*, 11*b* 11*c* illustrate users of different sizes when being seated in a posterior and shin supporting natural posture of balance with a substantially vertical position of the torso, FIG. 11*a* and 11*b* illustrating a user of smaller size, whereas FIG. 11*c* illustrates a user of larger size.

FIG. 21 and 22 illustrate a work-table support and a worktable, label, respectively.

DESCRIPTION OF PREFERRED EMBODIMENTS

Figure 1:
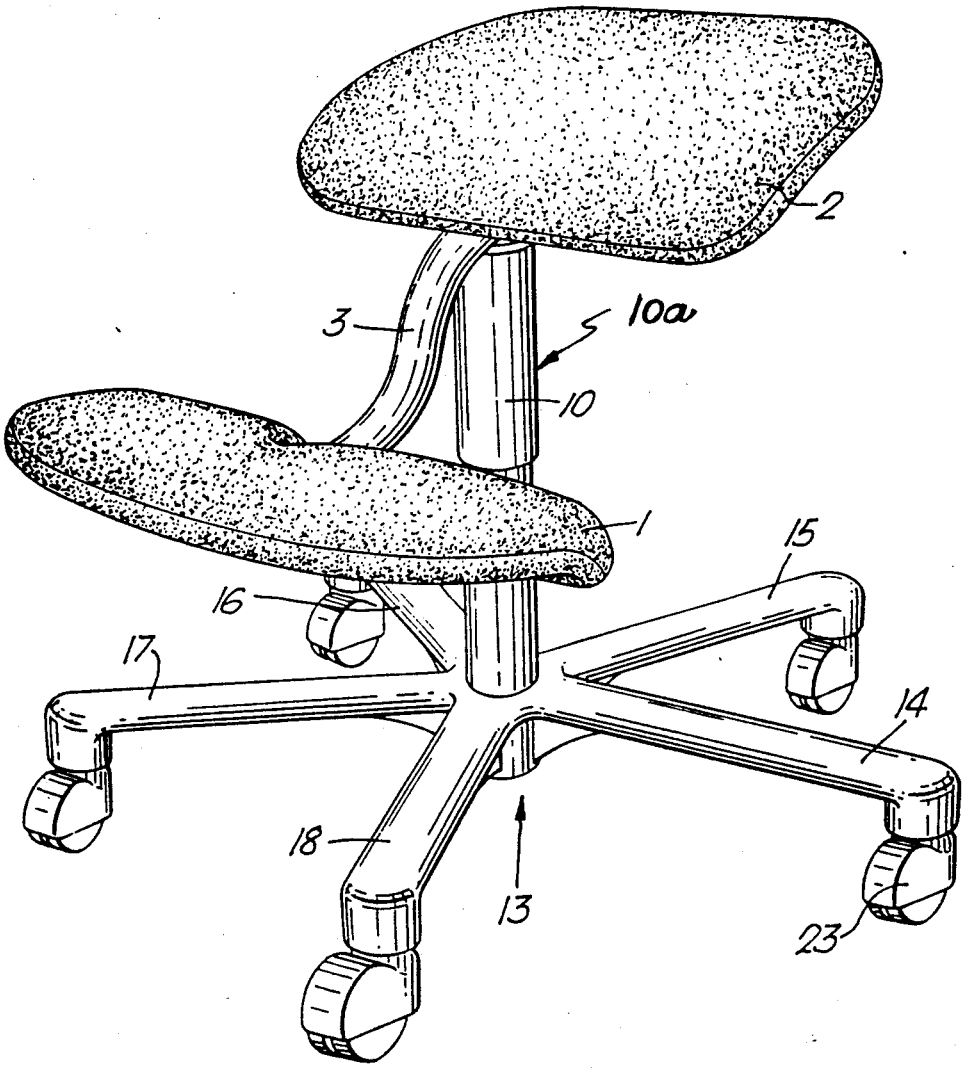
FIG. 1 and 2 illustrate a first embodiment of the present swivel stool or posterior and shin supporting chair.
Figure 2:
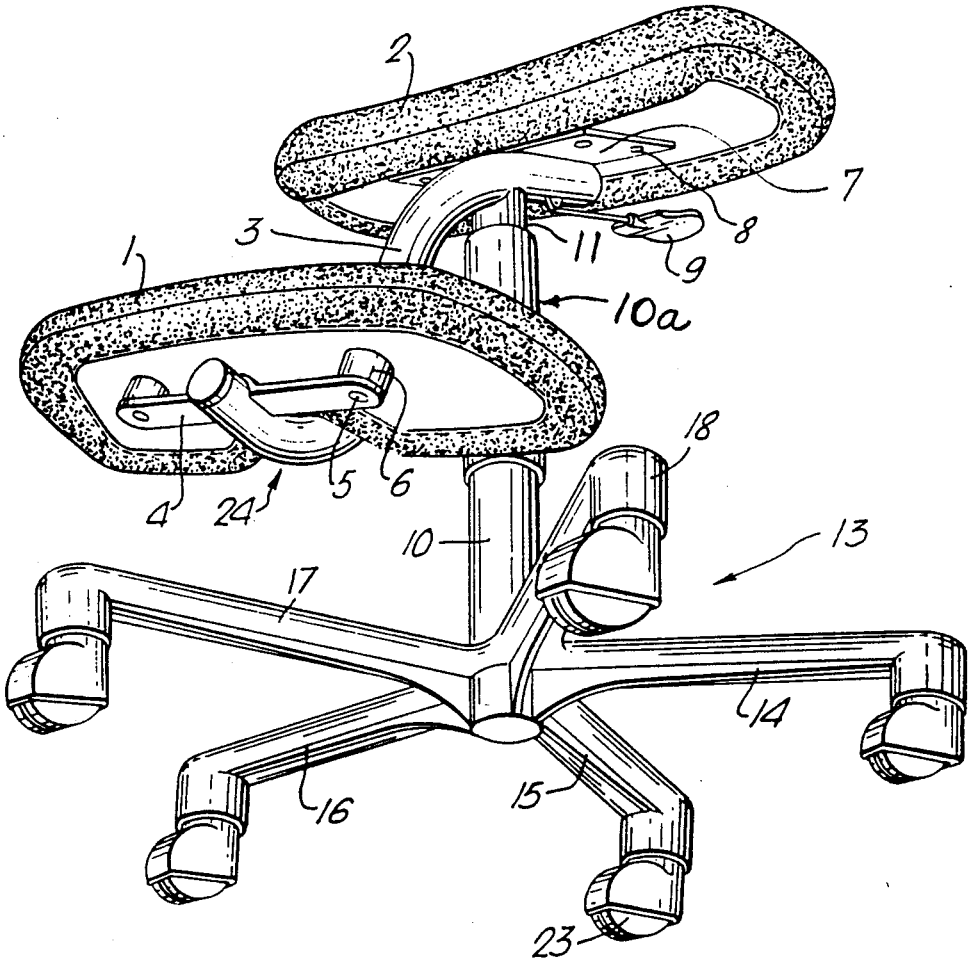

As illustrated in FIG. 1 and 2, which depict a first embodiment of a swivel stool or chair according to the present invention, the stool comprises a substantially flat shin support designated by reference numeral 1, and being spaced from and disposed at a level below and forward of a substantially flat preferably slanting seat support 2 arranged at a first level above the level of the shin support 1. The seat support 2 and the shin support 1 are interconnected by means of an interconnecting means 3, for example constituted by an inclined, and possibly curved frame part, possibly made of metal. In a preferred embodiment the interconnecting means 3 has a generally S-shaped configuration, as this is further illustrated in FIG. 8.

The interconnecting means 3 which generally takes the form of an elongated frame member is at its first end provided with a transverse member 4, which by means of bolts 5 keeps the shin support 1 attached to it. At the other end of the elongated interconnection means 3 the seat support 2 is mounted thereon, the interconnecting means 3 being rotatably mounted to a vertical supporting column 10*a* which rests on a base member 13.

At the upper end of the elongated interconnection means 3 there is provided a second transverse member 7 mounted transversely thereon and interposed between the interconnection means 3 and the seat support 2, for being attached thereto by means of for example screws 8.

In order to provide the seat support 2 as well as the shin support 1 with a certain yield when being loaded with the weight of the user of the stool, the first transverse member 4 at the lower end of the interconnection means 3 might be provided with elastic means 6, e.g. rubber blocks located between said transverse member 4 and the shin support 1. These rubber blocks 6 might of course be replaced by any appropriate yielding means, for example a rubber plate or similar.

To obtain the same type of resiliency at the upper transverse member 7 of the interconnection means 3, there might between the transverse member 7 and the seat support 2 be interposed resilient means, for example of the type as mentioned above in connection with the shin support 1.

At the upper region of the interconnection means 3, there is provided a release arm 9, which when actuated by the user controls a lifting and lowering mechanism 10, for example a pneumatic cylinder which adjusts the height of the interconnection means 3 within a predetermined range.

Figure 8:
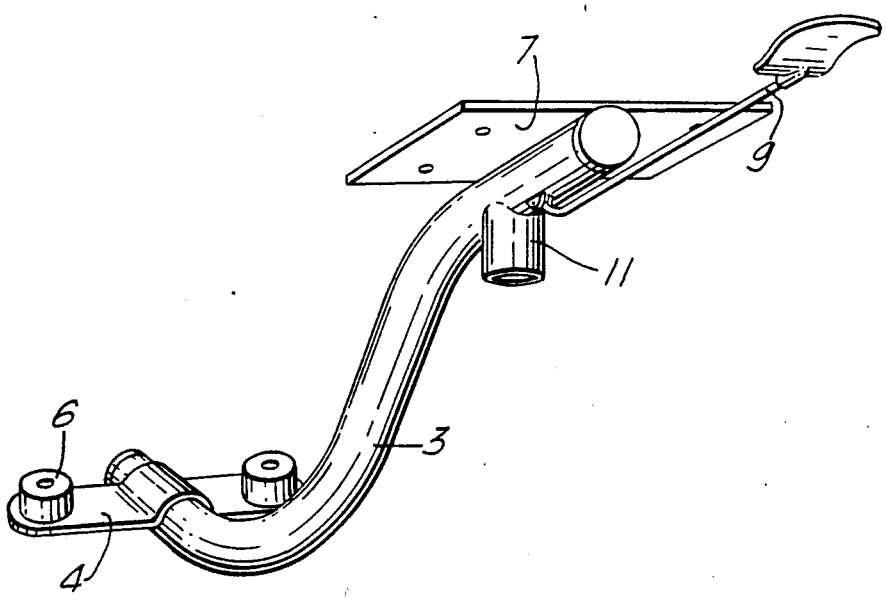
FIG. 8 and 9 are perspective views illustrating the interconnecting connecting means extending between the posterior and shin supports of the embodiments of FIG. 1–3 and FIG. 6 and 7, respectively.
Figure 9:
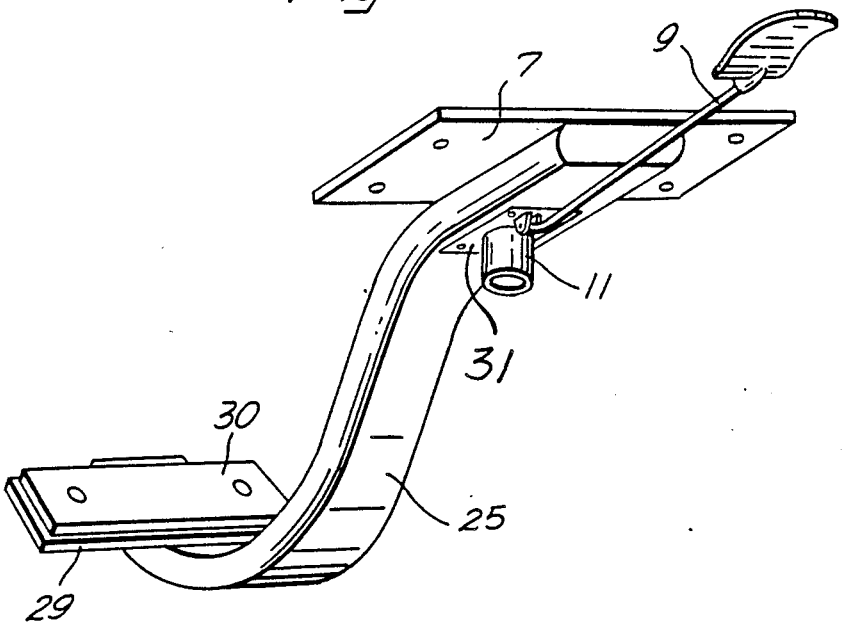
Figure 10:
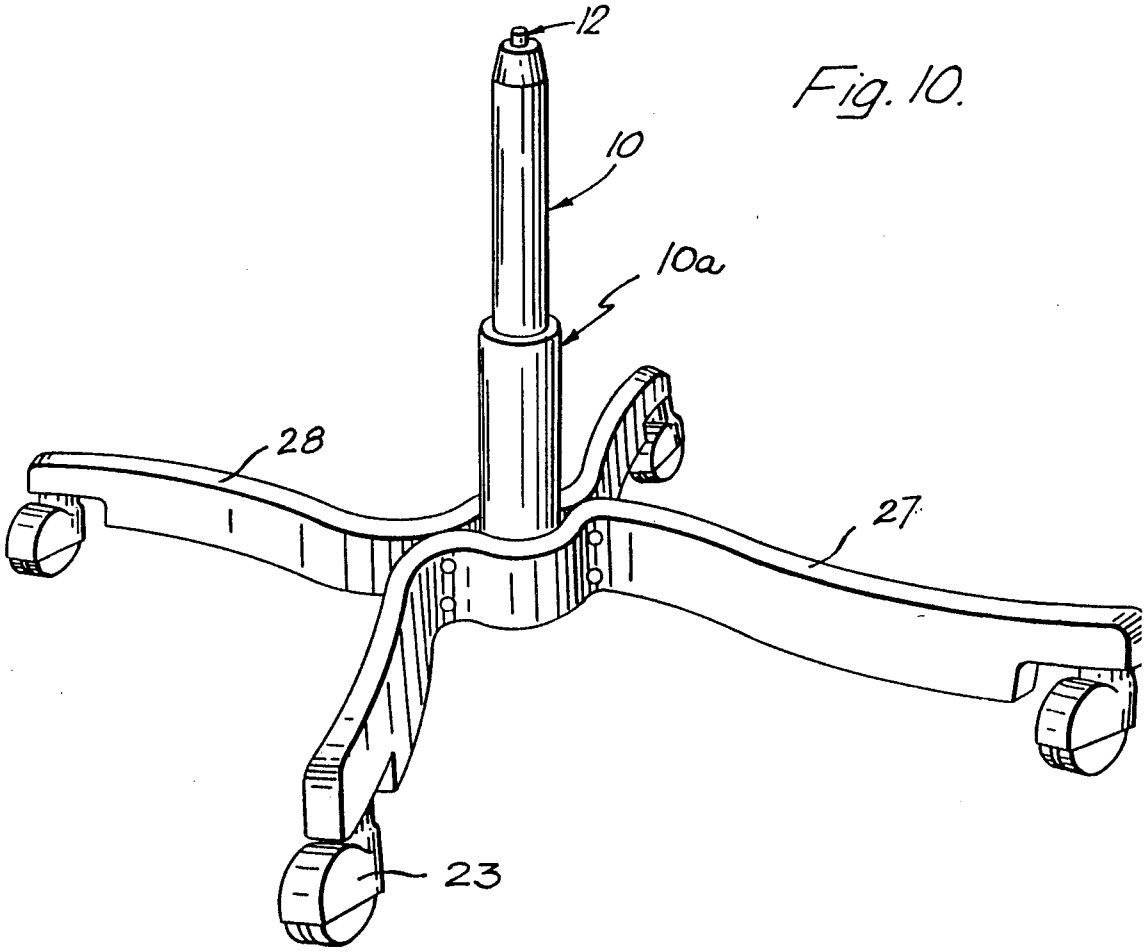
FIG. 10 is a perspective view illustrating the base member of a stool and the vertical supporting column extending upwardly therefrom and including a lifting and lowering mechanism.

The upper end of the lifting and lowering mechanism 10 fits into a female member 11 taking the form of a pipe-shaped sleeve depending from the upper part of the interconnection means 3, as this is more specifically illustrated in FIG. 8 and 9. The release arm 9 will when the stool is assembled, co-operate with a releasing means 12, as this is clearly illustrated in FIG. 10, and when this pin-shaped releasing means 12 is acted upon by the arm 9, said seat support 2 and the shin support 1 might be lifted or lowered simultaneously for height adjustment relative to the supporting column 10*a*, for thereby effecting a unison adjustment relative to the ground or relative to a separate working table, drawing desk, office desk or similar.

However, it should be understood that the lifting and lowering mechanism can be replaced by a conventional level adjustment mechanism, e.g. of the kind including a clamping device.

Figure 3:
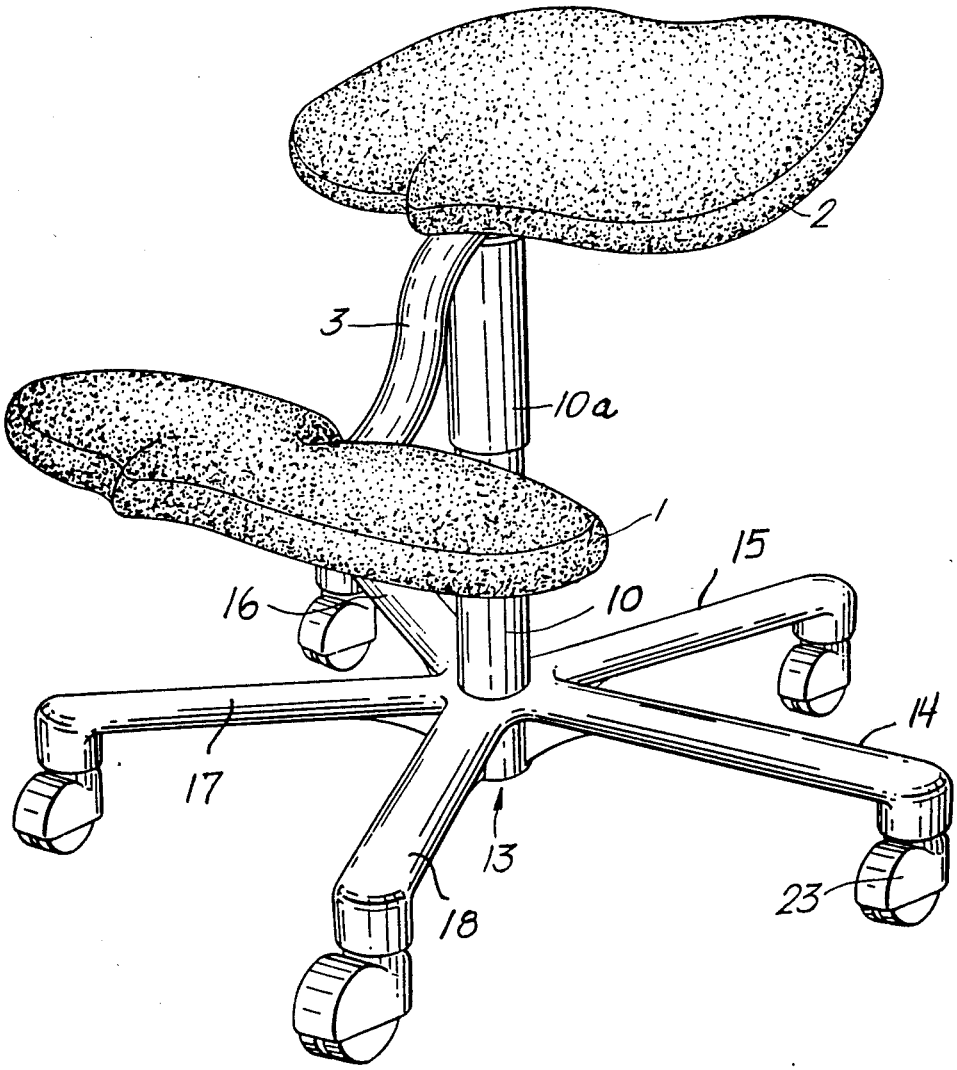
FIG. 3 is a perspective view illustrating a second embodiment of the stool.

The substantially vertical column 10*a* is at its bottom terminated by a base member 13, which for example might be provided with five substantially horizontal legs, designated by 14, 15, 16, 17 and 18 in FIG. 1, 2 and 3. At their free respective outer ends the legs are provided with a roller means 23, supporting the stool or chair on the floor and allowing for a desired horizontal mobility thereof.

The embodiment of the chair according to the present invention as illustrated in FIG. 1, 2 and 3 provides a swivel stool which is adjustable both as regards level, and as regards rotation about the vertical axis of the column 10*a*, because the elongated interconnecting means 3 is rotatably mounted on the vertical supporting column. Together with the rollers 23 mounted on each horizontal leg 14–18, the stool is also allowed to be displaced along the floor, which together with the above mentioned degrees of freedom are of importance when adjusting the distance from a table, a desk or similar.

As appearing from FIG. 1 and 2, the shin support 1 is preferably provided with a recess 24 in order to provide an appropriate shape in relation to the front end of the interconnection means 3. However, it is to be understood that within the scope of the invention the shin support 1 might not necessarily have the design as indicated, the design thereof being adapted to various shapes of the traverse member 4 at the front end of the interconnection means 3.

Figure 4:
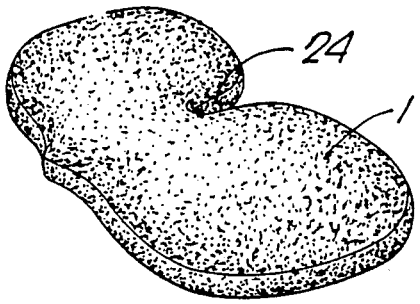
FIG. 4 and 5 are perspective views of the shin and posterior supports, respectively, as illustrated in FIG. 3.
Figure 5:
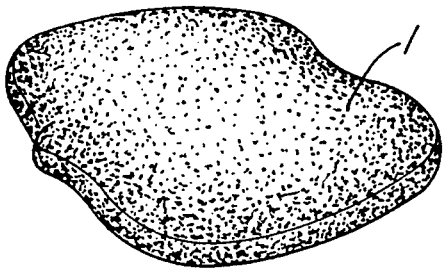

The shin support 1 and the seat support 2 might in this case have substantially the same design, for example as indicated in FIG. 4 and 5, in which said supports are shaped like a heart. However, it is to be understood that said supports might equally well have a substantially rectangular form, for example with rounded corners.

Figure 6:
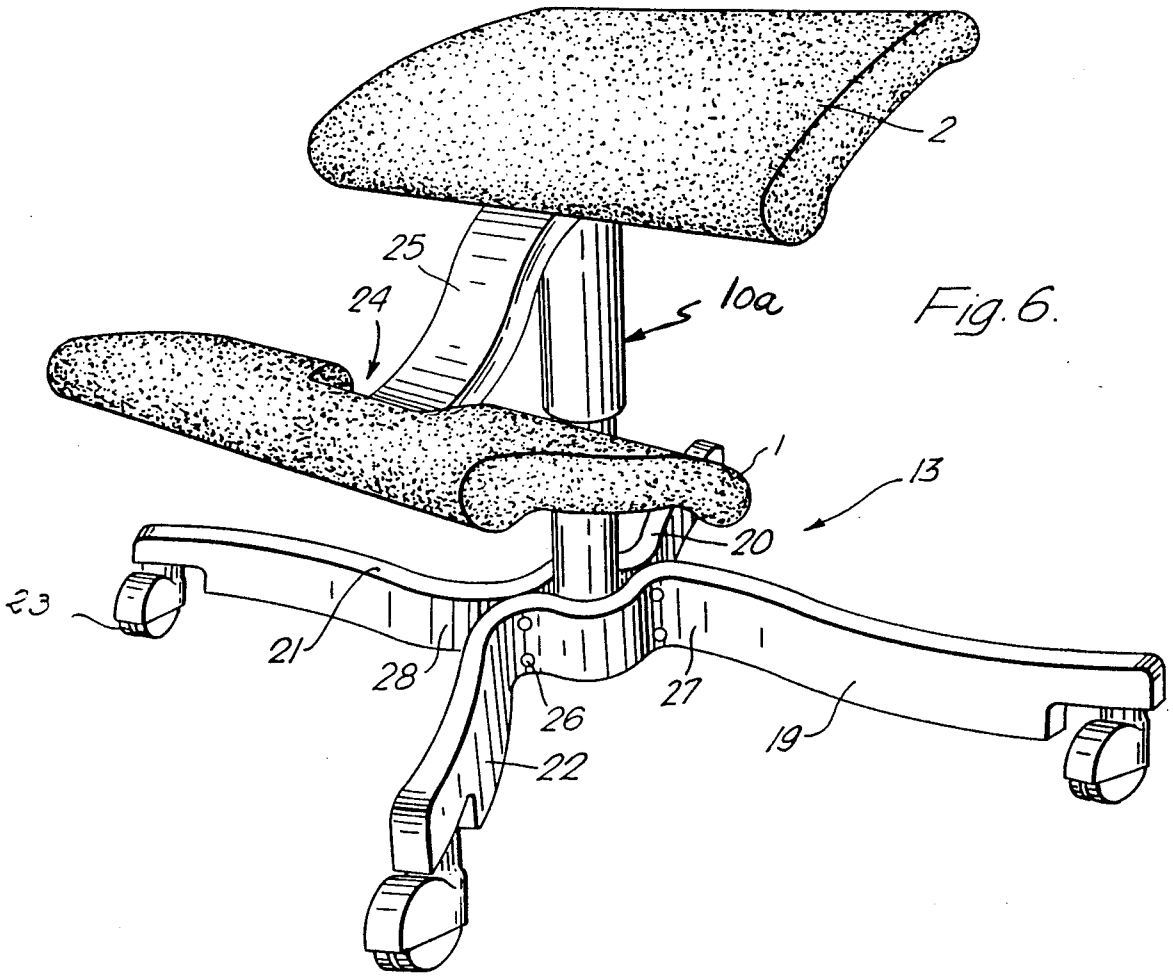
FIG. 6 and 7 are perspective views illustrating a third embodiment of present stool.
Figure 7:
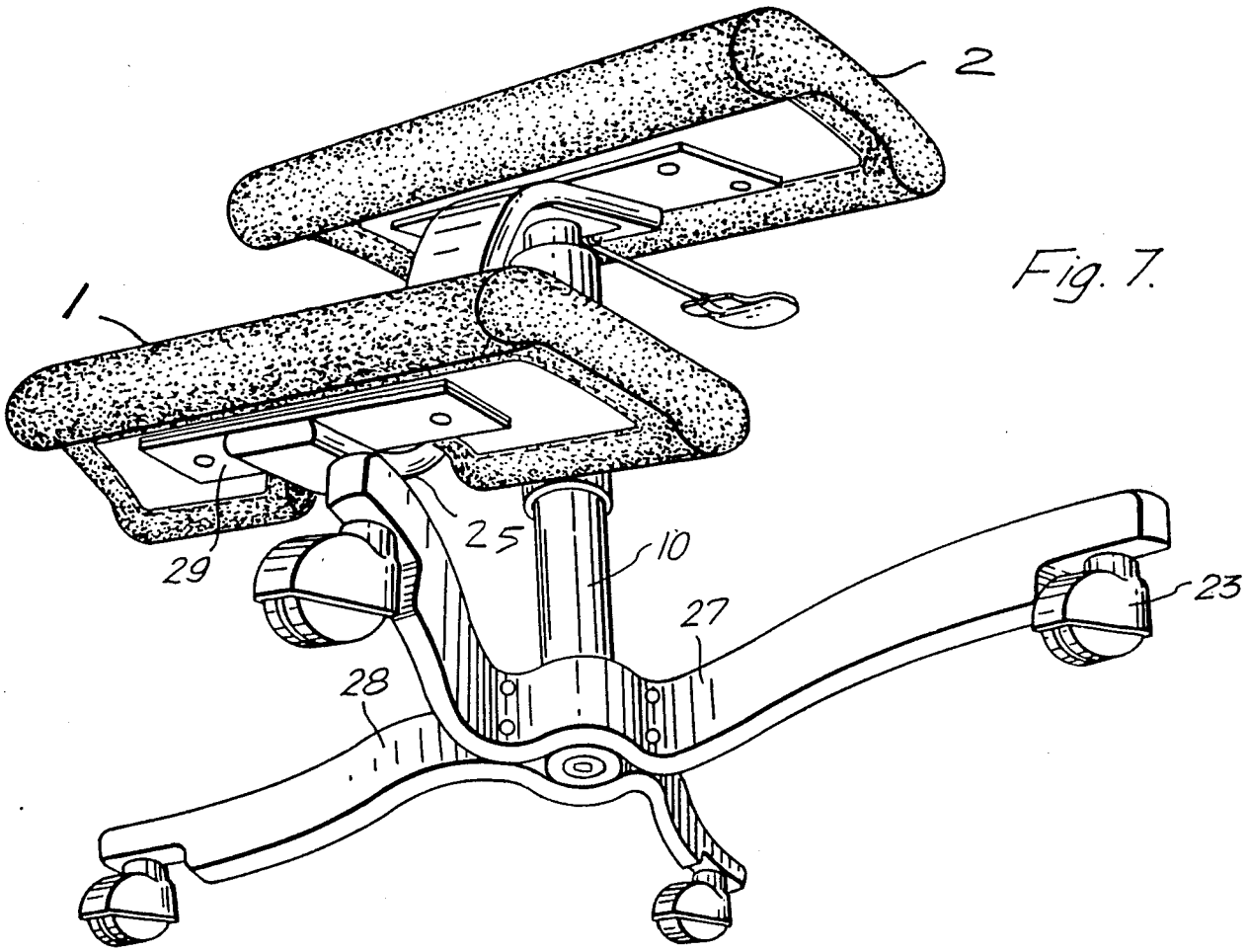

In FIG. 6 and 7 as well as in FIG. 9, there is illustrated a third embodiment of the present swivel stool. The interconnection means which is here designated by 24, has still a generally S-shaped configuration, but instead of having a round section, it is provided with a rectangular section, the interconnection means itself being made from laminated wood or similar. The horizontal legs of the base member 13, which here make a total of four and are designated 19, 20, 21 and 22, respectively, are constituted by two parts 27 and 28, which are joined by means of screw connections 26, or the like, for thereby encircling the lower end of the vertical supporting column 10*a*. Also in this case the legs 19–22 are provided with a roller means 23 at the outer ends thereof.

As appearing from FIG. 9 which illustrates the embodiment of the interconnection means 25 related to the chair illustrated in FIG. 6 and 7, this interconnection means 25 is somewhat different from the interconnection means 3 illustrated in FIG. 8 and being associated with the embodiments illustrated in FIG. 1–3. At its lower end the interconnection means 25 is provided with a transverse member 29 which on its upper surface is provided with a plate member 30 of elastic material, for example rubber. At its upper end the interconnection means 25 is provided with an attachment member 7, and since the interconnection means 25 is made from laminated wood, the release arm 9 and the attached female sleeve-like member 11 is mounted on a bracket 31 which is attached to the upper part of the interconnection means 25, for example by means of wood screws. The attachment of the shin support 1 to the transverse member 29 and the attachment of the seat support 2 to the attachment member 7 might be similar to that described in connection with the embodiments illustrated in FIG. 1–3.

Figures 11A, 11B, 11C:
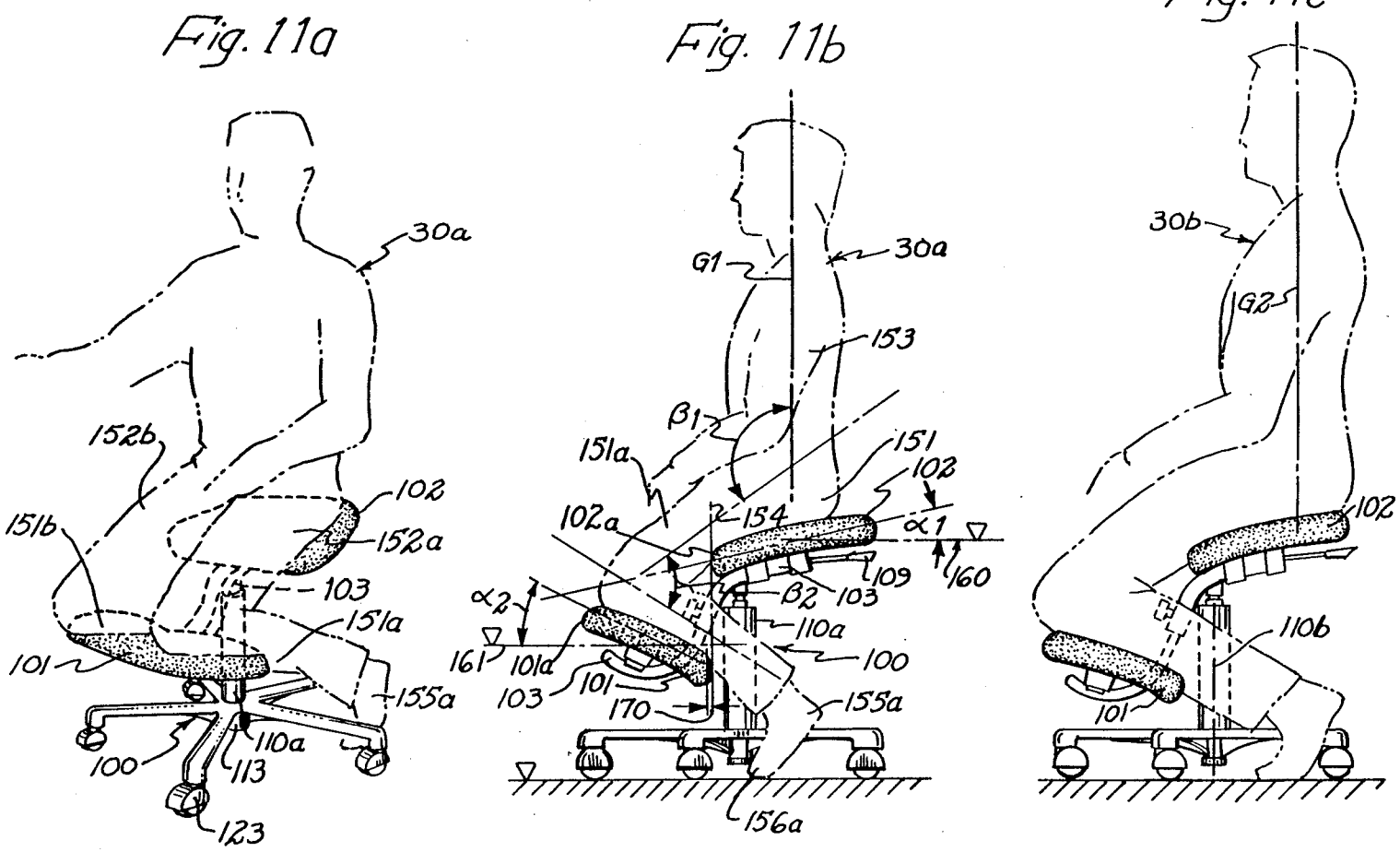

In FIG. 11*a* and 11*b* there is illustrated how a first person 30*a* will use the swivel stool or chair 100 according to the invention, and in FIG. 11*c* it is illustrated how a second person 30*b* which is larger than said first person 30*a* will use the same type of swivel chair as illustrated in FIG. 11*a* and 11*b*.

As illustrated in FIG. 11*a* and 11*b* the swivel chair according to the present invention comprises in combination a base member 113 and a substantially vertical supporting column 110*a* extending upwardly from said base member 113, for at the top thereof to bear a substantially flat preferably slanting support 102 arranged at a first level 160 at the top area of said column 110*a* for supporting the posterior 151 of a stool user 30*a*. Additionally, the swivel stool comprises a substantially flat shin support 101 spaced from and disposed at a second level 161 below and forward of said seat support 102, and preferably slanting in the opposite direction thereof, said seat support 102 and shin support 101 being interconnected by means of an interconnection means 103 which allows for said spaced and angular relationship between said seat support 102 and shin support 101. The spatial and angular relationship between the seat support 102 and the shin support 101 is arranged so that the user 30*a* with his posterior 151 rests on the seat support 102 whilst reducing the body weight acting downwardly thereon by resting his shins 152*a* and 152*b*, respectively, of his legs on said shin support 101 and by spreading the distributed body weight on said shin support 101 over the length of the shins 151*a* and 151*b*, respectively, for thereby taking a natural posture of balance with a substantially vertical position of his torso 153.

As especially appearing from FIG. 11*b* the seat support 102 might be inclined and angle $\alpha 1$ ranging from zero degrees to twenty degrees relative to said first horizontal level 160. The shin support 161 might preferably be inclined an angle $\alpha 2$ rangering from zero degrees to fourty-five degrees relative to said second horizontal level 161, said inclinations represented by $\alpha 1$ and $\alpha 2$, respectively, being opposite to each other.

Besides, the forward extention of the shin support 101 is approximately thirty centimetres (12 inches), relative to the inner edge 102*a* of the seat support 102, the forward direction here meaning the direction faced by the user 30*a* of the swivel stool.

Further, the spatial relationship between the seat support 102 and the shin support 101 in relation to a vertical plane 154 touching the inner edge 102*a* of said seat support 102, might be from slightly overlapping to a spatial distance 170 in the range of 0–5 cm (0–2 inches).

As previously explained in connection with the embodiments discussed above, the interconnection means 103 has a generally S-shaped configuration which at its lower end carries the shin support 101 and which at its upper end carries the seat support 102, said interconnection means 103 also being rotatably mounted on the vertical supporting column 110*a*. The vertical column 110*a* also, as indicated above, includes means 110 for simultaneously adjusting the height of the supporting column 110*a*, i.e. the common height of the seat support 102 and the shin support 101 relative to a third level 162 representing the ground or the floor.

This simultaneouse adjustment of the seat and shin supports Will allow the user to be lifted or lowered whilst still retaining the substantially vertical position of his torso, the height adjustment being adapted to the desk level of an office desk or a drawing table at which the user 300 of the chair 100 is to accomplish his work. A different height level of the swivel stool 100 indicated in FIG. 11*a* and 11*b* will be further discussed in connection with FIG. 12*a–12*c.

As previously discussed the base member 113 is equipped with roller means 123 to facilitate displacement of the swivel stool 100 on the floor level 162, which might be required in case the user 30*a* will move his chair along the desk in front of which he is sitting.

It should be noted that the natural posture of balance with a substantially vertical position of the torso, as this is illustrated in FIG. 11*a* and 11*b*, is commonly known as a kneeling-like sitting posture, althought it should be emphasized that the load on the lower leg must always be spread over the length of the shins, and not the knees for avoiding exerting excessive point forces thereon, and that the support of the posterior of the user must always be such that there will exist an angle $\alpha 1$ between the torso 153 and the user's thighs 152*a*, 152*b*, which is always larger than ninety degrees, so as to retain the natural free swaying position of the spinal column that does not require considerable muscle work, for thereby in this balanced position making any back support quite unnecessary.

It should further be emphasized that in order to obtain the kneeling-like sitting posture it is necessary that the angle $\alpha 2$ between the user's thighs 152*a*, 152*b* and the user's legs 151*a*, 151*b* should be smaller than ninety degrees in order to allow for a load on the lower leg to be spread over the length of the shins and not the knees.

Finally, it should be noted that the outer edge 101*a* of the shin support 101 should not intersect the extended notional plane of the seat support 102 in any angular position thereof.

As further indicated in FIG. 11*a* and 11*b* the feet 155*a* of the user 30*a* can either be hanging freely from the shin support 101 as a free extention of the user's legs, or might be lightly supported on the floor level 162 by a light touch of the user's toes 156*a* thereon. This light touch of the toes 156*a* can, however, be used as a motivating force for displacing the swivel stool along the floor level 162 when the user wishes to changes his relative position on the floor, for example towards or away from a working desk or drawing table.

In FIG. 11*c* another user 30*b* of a larger size than the user 30*a* in FIG. 11*a* and 11*b* has taking the same kneeling-like sitting posture, and it should be noted that although the seat support 102 as well as the shin support 101 have the same mutual spatial and angular relations as in the embodiments illustrated in FIG. 11*a* and 11*b*, the swivel stool still accommodate a kneeling-like sitting posture of the larger user. This is due to the fact that the larger user 30*b* can obtain the same angular relation between his torso and his thighs, as well as between his thighs and legs, as the case is in connection with FIG. 11*a* and 11*b*, the only difference in sitting posture being that the point of gravity of the larger user 30*b* is acting along a line G2 which is further from the center line 110*b* of the vertical supporting column 110*a* as compared with the line G1 along which the point of gravity of the user 30*a* is acting.

Figures 12A, 12B, 12C:
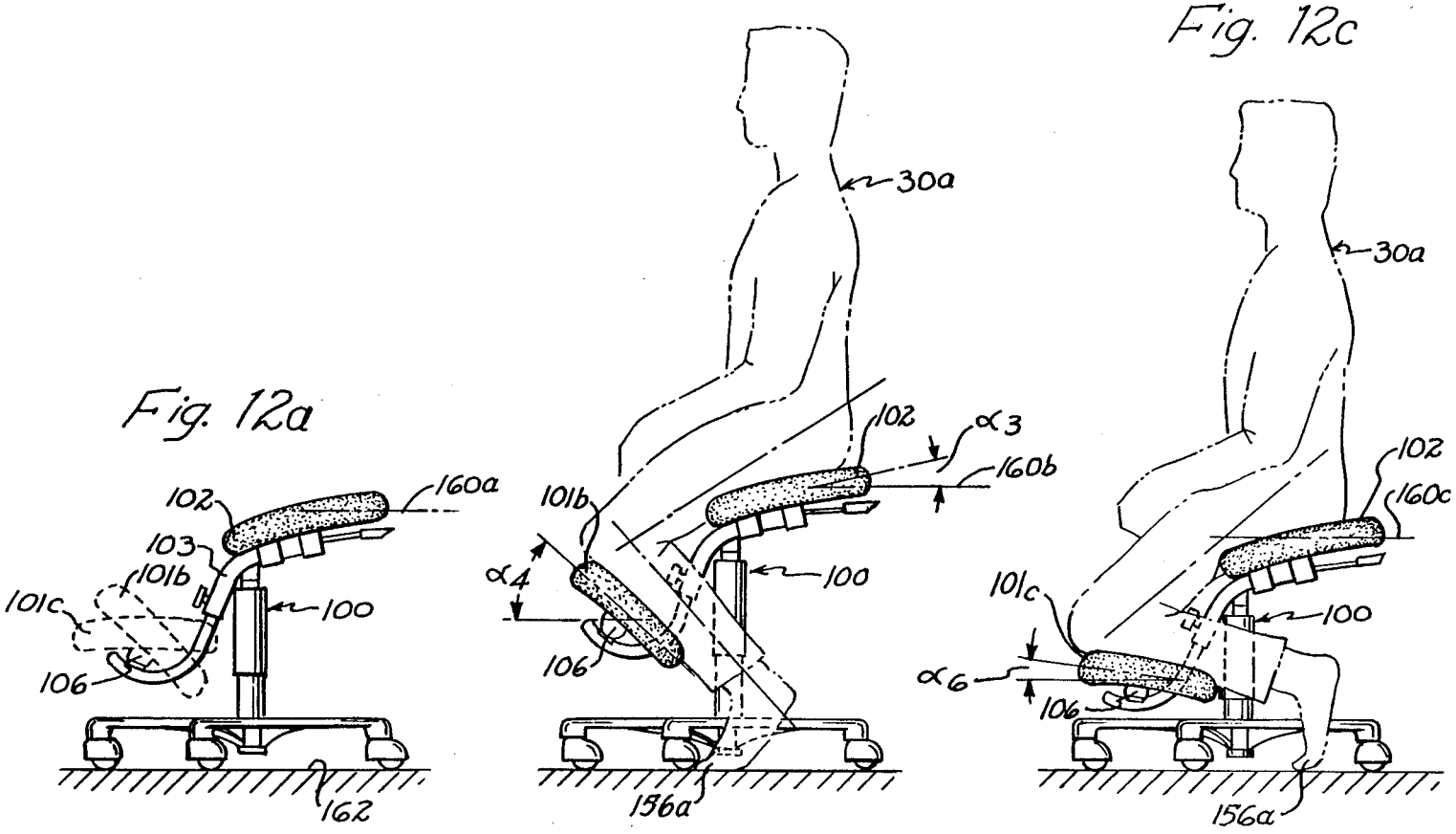
FIG. 12*a*, 12*b* and 12*c* illustrate the users of FIG. 11*a*–11*c* in a raised and lowered position of the stool relative to the positions illustrated in FIG. 11*a*–11*c*.

In FIG. 12*a–12c* it is indicated how a user 40*a* will still retain his kneeling-like sitting posture even if the seat support 102 and the shin support 101 have been raised or lowered simultaneously relative to a working level of a separate drawing table or an office desk.

In FIG. 12*a* the swivel stool 100 is illustrated with the seat support at a first level 160*a*, and the shin support is illustrated in two angular positions 101*b* and 101*c*, respectively, which are allowed due to the resilient member 106 interposed between the bottom face of the shin support and the interconnection means 103. In FIG. 12*b* the user 30*a* has raised the seat support 102 to a higher level 106*b* compared with the level 160*a* in FIG. 12*a* and the level 160 in FIG. 12*b* . As the user 30*a* is of approximately the same size, he would in the posture of FIG. 12*b* prefer a larger angle $\alpha_4$ of the shin support 101*b* to allow a distribute load over the full length of his shins, whereas only a minor change of the angle $\alpha_3$ of the seat support 102 is required. In this position the user 30*a* will still reach the floor 162 with his toes 156*a*.

In FIG. 12*c* the person 30*a* has lowered the seat support 102 to a very low level 106*c*, requiring a slanting $\alpha_6$ of the shin support 101*c* which is rather small, but the load on the shin support is still distributed over the full length of the user's shins, and his feet can still protrude freely behind the support and lightly touch the floor by the toes.

To further illustrate the difference between the above described kneeling-like sitting posture allowing for a natural posture of balance with a substantially vertical position of the torso, as compared with a sitting posture to be accommodated in a chair or swivel stool of previously known design, reference is made to FIG. 13*a–13d*.

In these Figures there is illustrated a swivel stool generally designated by 49, and comprising a swivel stool seat 410 supported by a central column 418 which can be adjusted within a predetermined range. A foot rest 426 comprises a pair of downwardly extending leg portions 430 and a horizontal foot supporting bar 432 extending between the bottom of said leg portions 430. The foot rest 426 is rigidly attached to the seat 410 and can rotate and move up and down when the seat 410 is moved up and down. The bottom of the column 418 is movable supported by four conventional casters 424, each of which is mounted on a substantially horizontal leg 422 making up the base 420. The foot-supporting bar 432 allows the user 400 of the swivel stool 49 to sit on the chair portion 410 and, with his knees 400*a* bent to varying degrees, rests the base of the foot 400*c*, but not the shin 400*b*, on the foot rest 432.

Figure 13A:
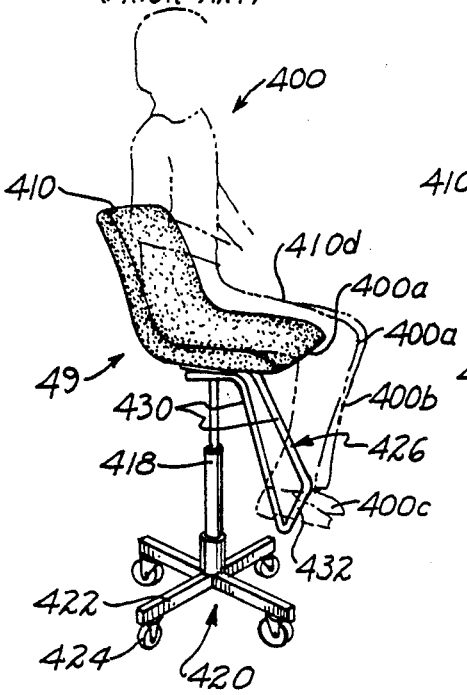
Fig. 13a (PRIOR ART)
FIG. 13*a*, 13*b*, and 13*c* and 13*d* illustrate the use of a prior art stool with a foot rest used for obtaining the posterior and shin supporting posture of balance with a substantially vertical of the torso.

FIG. 13*a* illustrates the previously known stool how to be used as intended.

Figure 13B:
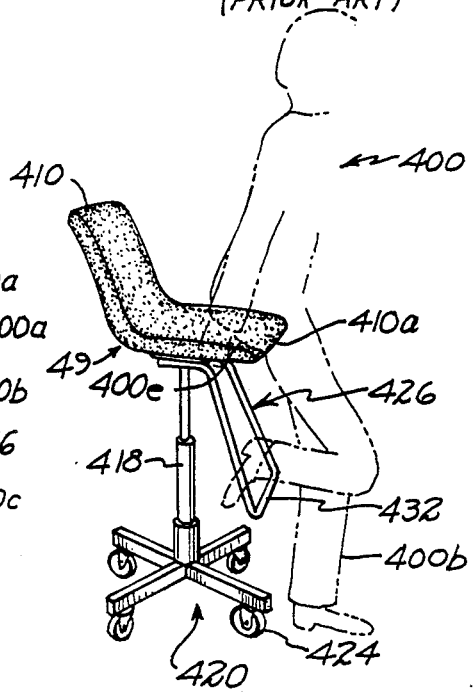
Fig. 13b (PRIOR ART)

FIG. 13*b* shows the dangerous and difficult maneouvre which will be necessary for the user 400 to try to employ the foot rest 432 as a shin support, bearing in mind that only front entry is possible, and that somehow the posterior 400*e* must be balanced on the front edge 410*a* of the stool 49, while the feet 400*c* are being threaded through the support bar 426.

Figure 13C:
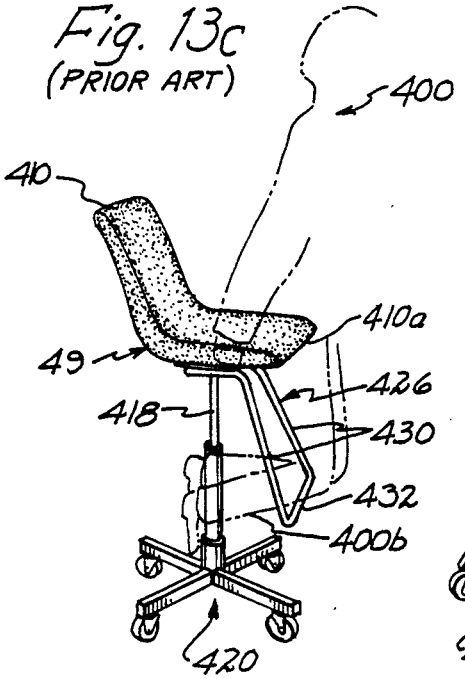
Fig. 13c (PRIOR ART)

FIG. 13*c* illustrates the ungainly position which would be adopted by the user 400 of the stool 49, and illustrates firstly how dangerous such a posture is in that the user 400 is at great risk of falling forwards from the stool 49, or even topling together with the stool 49, and furthermore needs to use both hands in order to balance the posterior precariously on the front edge 41*a* of the stool seat 410. It should be noted that the shin supporting position which the user 400 tries to obtain in FIG. 13*c*, is in no way comfortable, and is in no way a natural posture of balance, in which he can place his lower arms comfortably on his thighs.

Figure 13D:
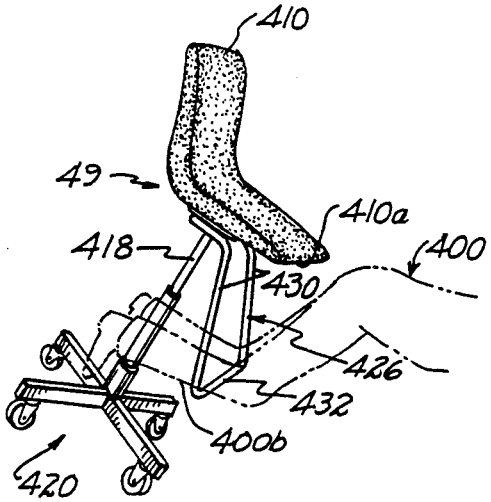
Fig. 13d (PRIOR ART)

On the contrary, the unnatural posture taken by the user 400 FIG. 13*c* will in the worst case end up in the mess illustrated in FIG. 13*d*, which ironically might be an unintentional relief of the uncomfortable pressure of the foot rest bar 432 against the upper shin 400*b* in the nested configuration shown in FIG. 13*c*.

Figure 14:
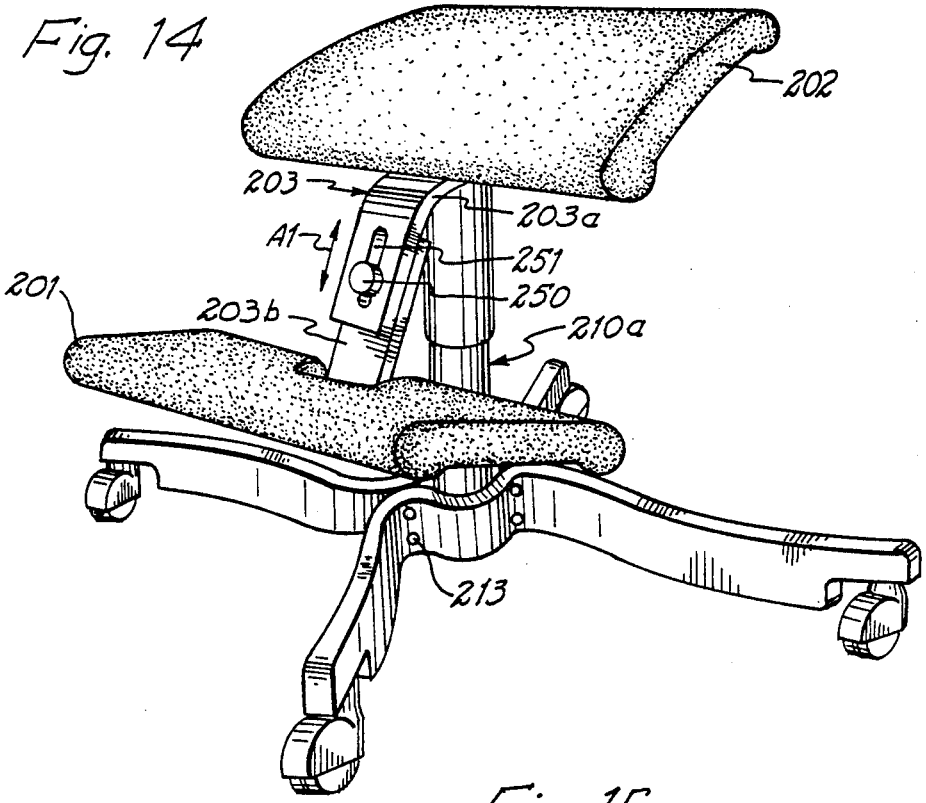
FIG. 14 and 15 are perspective views of an embodiment of a stool according to the present invention, including means for adjusting the distance between the seat and shin supports.
Figure 15:
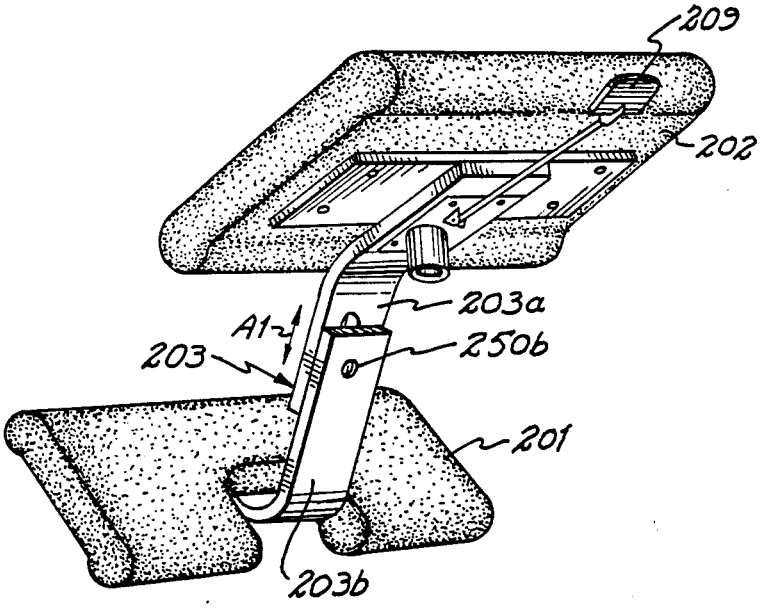
Figure 16A:
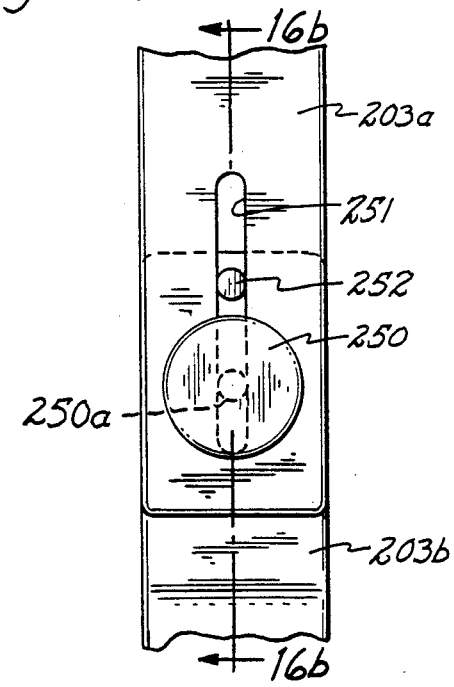
FIG. 16*a* and 16*b* illustrate on a larger scale the adjustment means according to FIG. 14 and 15, FIG. 16*a* representing a front view, whereas FIG. 16*b* being a section taken along the lines A–A, in 16*a*.
Figure 16B:
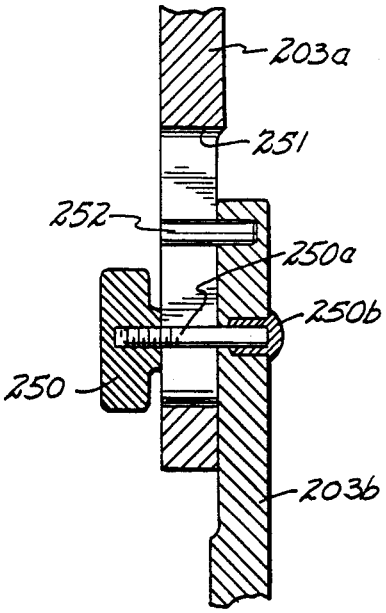

In FIG. 14 it is illustrated a further embodiment of the present swivel stool, the interconnection means 203 between the shin support 201 and the seat support 202 comprising means for adjusting the distance between said supports. The adjusting means illustrated in FIG. 14, 15 and 16*a* and 16*b*, comprises two members 203*a* and 203*b* held together by friction means, the first member 203*a* representing an upper part of said interconnection means 203, and including a rotatable friction nob 250 to be tightened to create a friction force, and a second member 203*b* representing a lower displaceable part to be loosened by said friction nob 250 when untightening the same.

The friction nob 250 is located at the front of said upper member 203*a* of said interconnection means 203, and extends rearwardly through a slit 251 in the same member of said interconnecting means 203, the length of the slit 251 in the longitudinal direction of said upper member 203*a* defining the distance the shin support 201 can be adjusted relative to the seat support 202.

The friction nob 250 communicates with a combined tightening and guiding pin 250*a* extending from the nob 250 at the upper member 203*a* through said slit 251 and protruding therefrom to mount said friction nob at the one end thereof, the other end of the combined tightening and guiding pin 250*a* being anchored in a fixing means 250*b* provided in the lower member 203*b* of the interconnection means 203.

The friction means also includes a second guiding pin 252 extending from the lower member 203*b* and throuqh said slot 251, but at a given distance from said first combined tightening and guiding pin 250*a*.

It should be noted that the upper and the lower member 203*a* and 203*b*, respectively, have a substantially rectangular cross section, so as to provide friction surfaces in the area in which the two elements are overlapping, an overlapping area which can be extended and reduced depending on the desired spatial relation between the seat support 202 and the shin support 201. The lowering and hoisting adjustment which can be undertaken by means of the adjustment means is indicated by the double arrows A1.

In FIG. 17, 18 and 19*a*–19*c* there is illustrated yet another embodiment of the swivel stool or chair according to the present invention, in which a second embodiment of an adjustment means have been included, comprising a first upper pipe-shaped member 303*a* representing an upper part of the interconnection means 303, in which upper pipe-shaped member 303*a* there is arranged a lower pipe-shaped member 303*b* for telescopic displacement allowing for said spatial adjustment, the displacement of said lower member 303*b* being regulated by a friction means arranged between said pipe-shaped members.

Figure 19A:
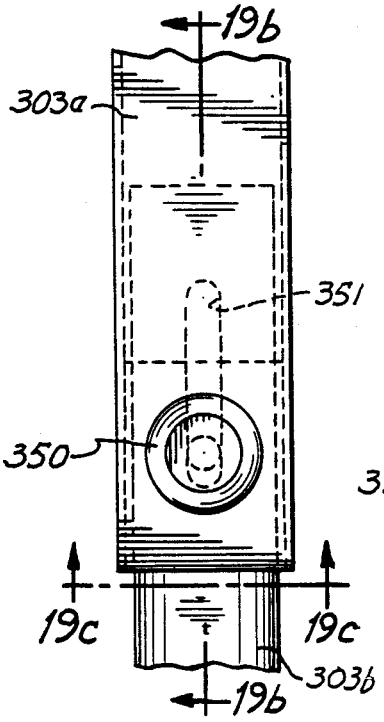
FIG. 19*a*, and 19*b*and 19*c* are on a larger scale illustrations of details of the adjusting means depicted in FIG. 17 and 18, FIG. 19*a* representing a front view, whereas FIG. 19*b* being a section taken along the lines B—B in FIG. 19*a*, and FIG. 19*c* representing a transverse section taken along the lines C—C in FIG. 19*b*.
Figure 19B:
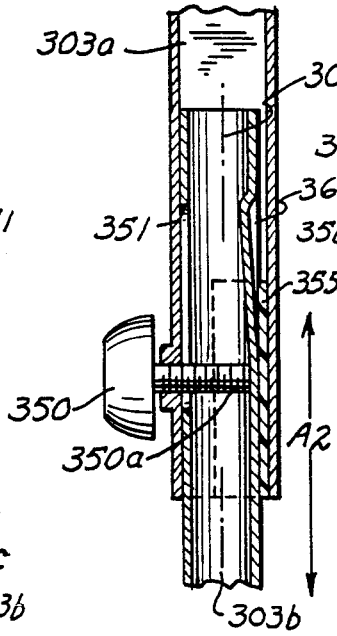
Figure 19C:
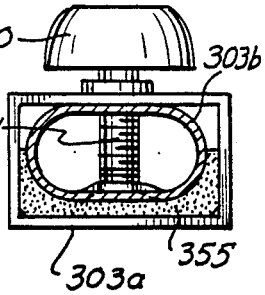
Figure 17:
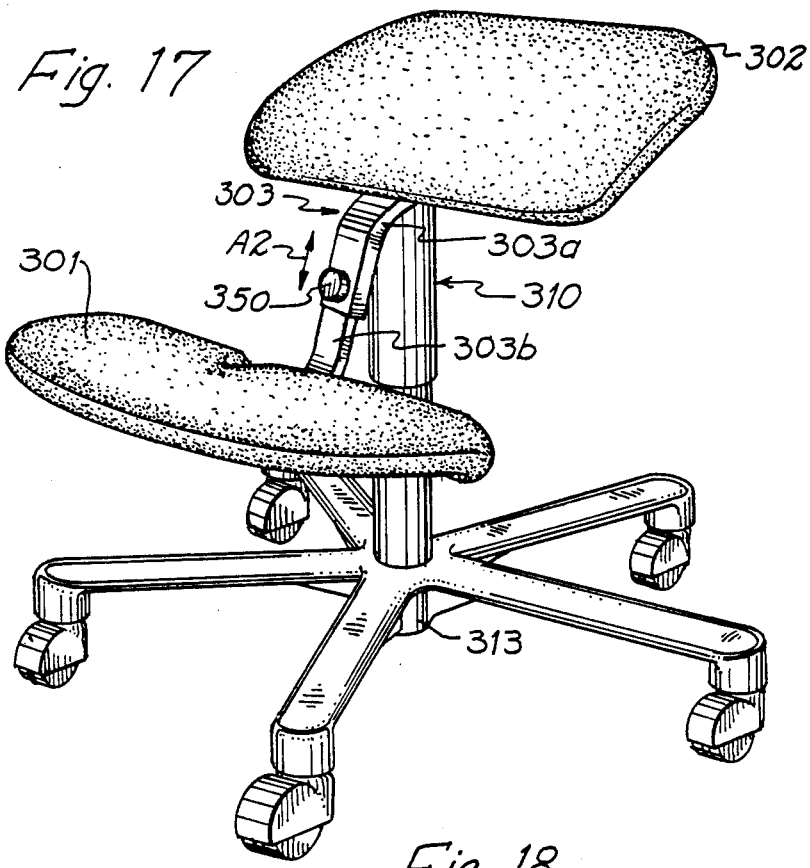
FIG. 17 and 18 are perspective views of an embodiment of a chair according to the present invention, including a second embodiment of a means for adjusting the spatial relationship between the seat and shin supports.
Figure 18:
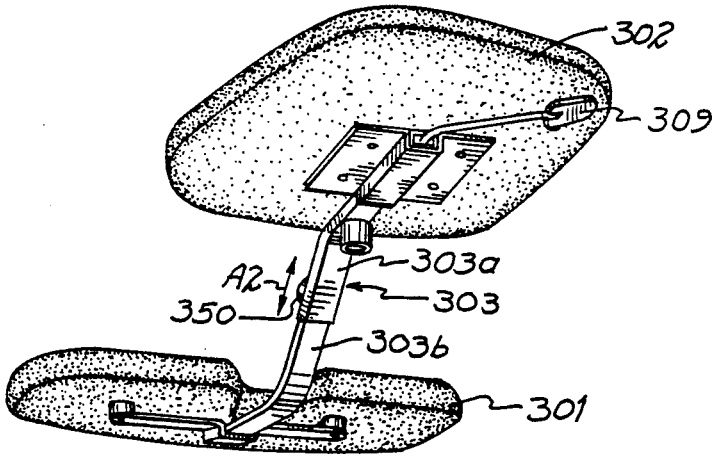

As best can be seen from FIG. 19*a*–19*c*, the inner lower tubeshaped member 303*b* holding the shin support 301, is provided with a longitudinally extending slit 351 into which a transversely extending combined guiding and friction promoting pin 350*a* extends, said pin 350*a* at its first end protruding through the adjacent wall of said outer member 303*a* for carrying a nob 350 which upon rotation displaces the pin 350*a* in a first or second transverse direction, for thereby respectively promoting or releasing the friction force between said upper and lower member 303*a* and 303*b*.

It should be understood that the pin 350*a* bearing the friction nob 350, upon rotation of said nob 350 in a friction promoting direction will press against the inner wall of the lower pipe-shaped member 303*b* for urging said wall against a friction pad 355 arranged between the outer wall of the lower pipe-shaped member 303*b* and the inner wall of the pipe-shaped upper member 303*a* housing said lower member 303*b*.

It should also be noted that the upper pipe-shaped member 303*a* has a substantially rectangular hollow section, whereas the lower pipe-shaped member 303*b* housed therein, has a substantially round or oval hollow section, comprising in the area where said friction pin 350*a* abuts the inner wall of said lower pipe-shaped member 303*b*, a zone which is inwardly bulging towards the center line 303*c* of said lower pipe-shaped member 303*b* for thereby embracing the friction pad 355 interposed between said elements 303*a* and 303*c*.

The relative displacement between the upper element 303*a* and the lower element 303*b* is indicated by the double arrows A2.

In order to provide a work-table on a chair of the above discussed type, it is proposed to remove a sealing member from the front of the interconnection means 3 illustrated in FIG. 2, so as to allow for the insertion of a tube 32 into the front end of said pipe-shaped interconnection means 3, as this is indicated in relation to FIG.

20, 21 and 22. The end 33 of the tube 32 must therefore have a dimension which enables it to fit into the tubular front end of the interconnection means or frame 3. The lower part of the tube 32 constitutes an elongation of the lower region of the frame part 3 in a forward direction thereof, and at the front edge of the supporting member 1 it extends substantially vertically upwards. The tube 22 is at its top provided with a supporting member 34 for a table top 35. Further, there are provided two laterally disposed supports 36, 37, which at their lower inwardly bent ends are attached to the outer ends of the transverse member 4 by means of said screws 5 or by other screws which fit into holes in the transverse member 4.

Like the tube 32, the lateral supports 36, 37 are preferably also tubular and bent approximately like the tube 32. The vertical portion of the tube 32 is connected to the lateral supports by means of rivets, by welding or by screws. The lateral supports 36, 37 are at their upper ends bent in the direction of the supporting means 2 and are connected to the supporting means 34 at the rear end thereof, as will appear from FIG. 20.

Figure 20:
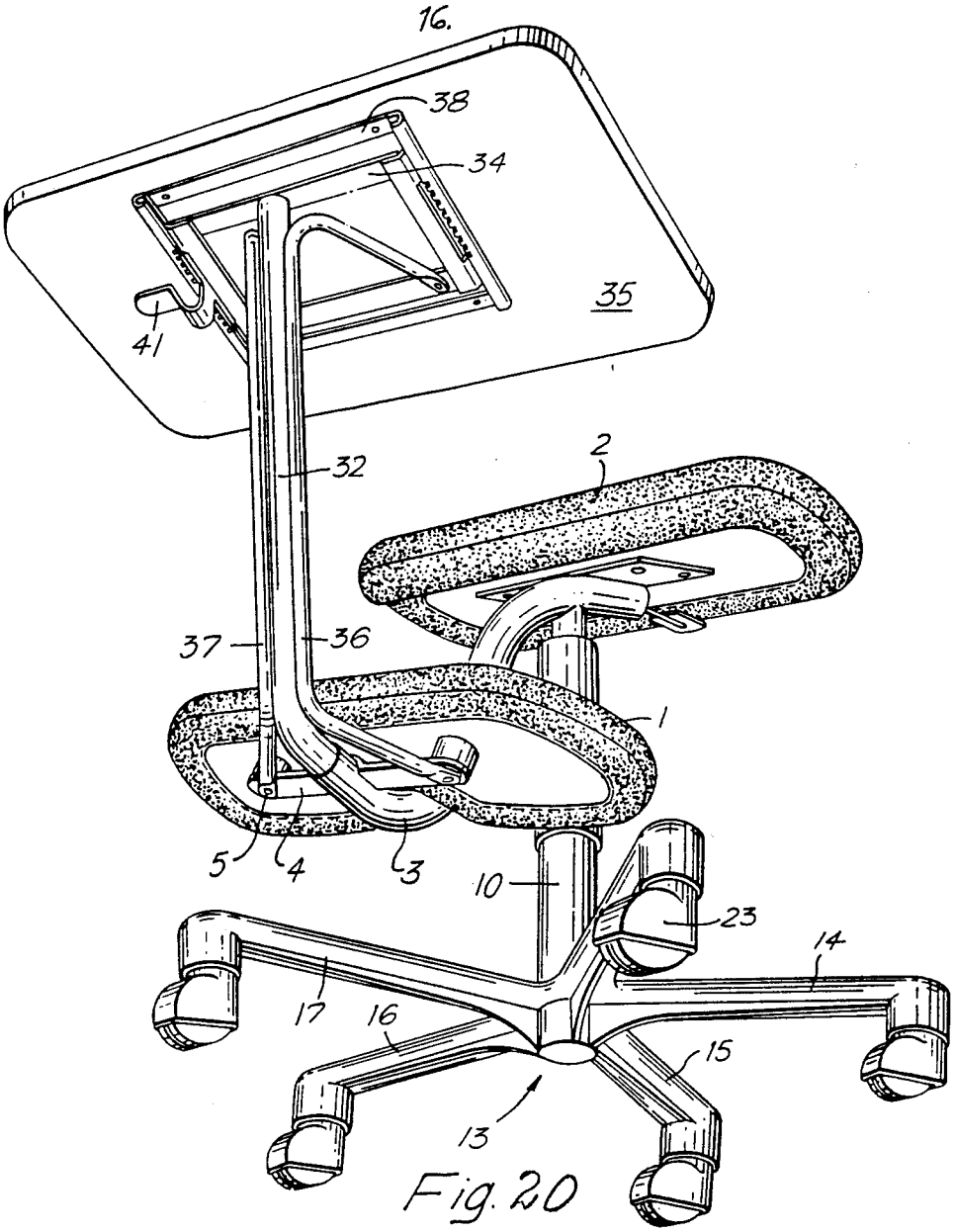
FIG. 20 illustrates a fourth embodiment of the stool according to the present invention, provided with a work-table device.

As shown in FIG. 20 and 21, the table top 35 is provided with a second attachment member 38, which is slidably connected to the first attachment member 34, in order that the distance between the supporting members 2 for the posterior and the table top 35 can be adjusted. From FIG. 21 it appears that the attachment member 38 is provided with slide means 39 which coact with slide rails 40 on the said second attachment member 38. The table top may, by means of an attachment arm 41 which is provided on the first attachment member 32, be in engagement with teeth 42 provided on the slide rails 40 of the attachment member 38, for thereby fixing the relative position of the first and second attachment members 34 and 38 in the preferred selected position.

In order to avoid that the chair with its installed table top tilts in a forward direction when a person sits on the chair, it is preferred that the base member has either sufficient weight to prevent such tilting, or base member arms of such length that sufficient stability is obtained.

In the case when the base member and the frame part 3 is made from laminated wood, it is within the scope of the invention to adapt the embodiment such that the tubular supports 32, 36, 37, e.g. can be made of laminated wood and be attached to the transverse member 4 and connected to the frame part 3 by means of a screw connection or a male/female connection. The attachment of the table support onto the attachment member 34 can be made in a manner known per se, by means of suitably designed brackets.

Figure 23:
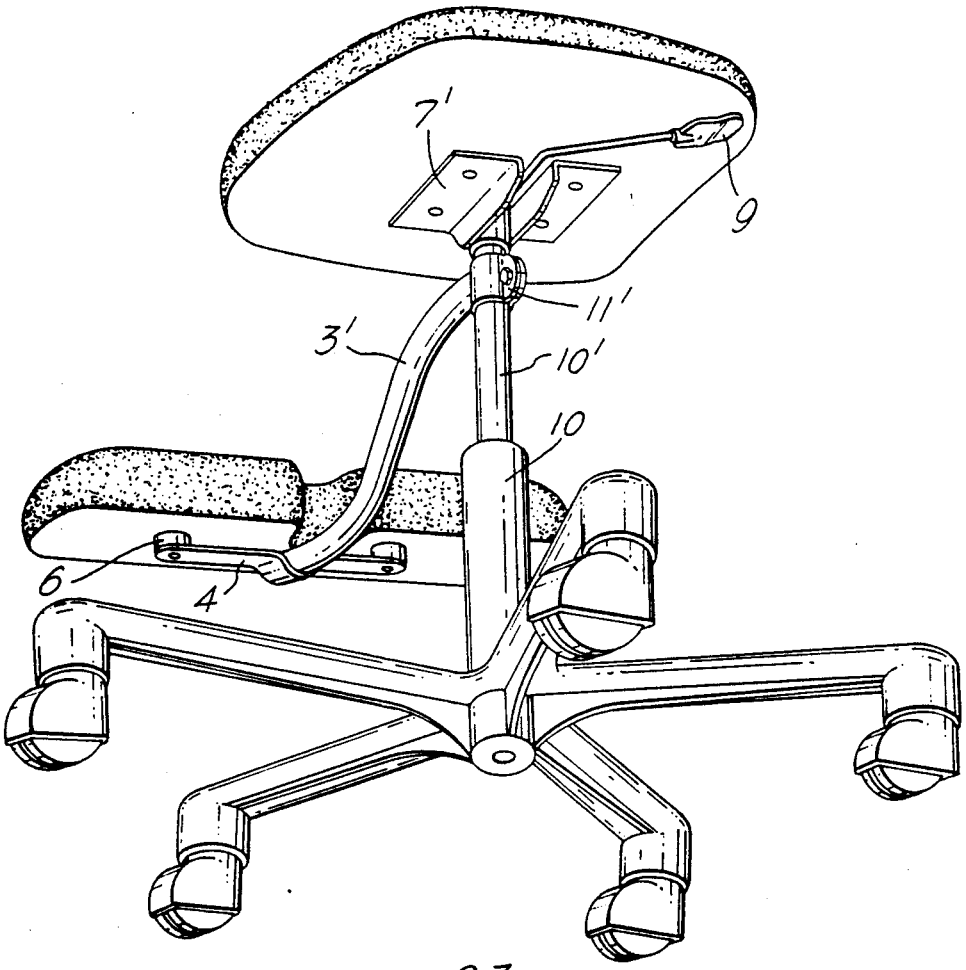
FIG. 23 illustrates a further embodiment of the stool according to the invention.

The embodiment of FIG. 23 is a variant of the previous embodiments shown in FIG. 1–3. The lifting/lowering mechanism 10 has a centrally disposed member 10', which upon operation of the release lever 9 will move relative to the lower, surrounding member of the mechanism 10. The frame part 3' which forms a link between the supports for the shins and posterior of the chair occupant, is connected to said centrally disposed member 10' at the upper end thereof by means of a bracket 11'. The attachment member for the posterior support is labelled 7'. The uppermost end of the member 10' is attached to the attachment means 7' by means of the previously described attachment female member 11.

It is readily understood that the embodiments described and shown only serve as examples and that these may be modified and replaced by technical equivalents without departing from the scope of the invention.

Further, it is possible to modify the shape of the supporting members for the shins and posterior, the mutual dimensions of the individual parts, the number of legs in the base member, the configuration of the frame parts, the lifting/ lowering mechanism etc. without departing from the scope of the invention.

By means of the present invention, there is provided a chair having a maximum of mobility while the person occupying the chair assumes a kneeling-like sitting posture, i.e. a posture in which the pelvis achieves an oblique open angle without sliding off the seat support, the physiological curves of the lumbar column are sustained, and in addition the cave of the body attains its maximum volume and the arms can hang loose from the shoulder-joints.

What is claimed:

1. A swivel stool or chair, comprising, in combination:

a base member;

a substantially vertical supporting column extending upwardly from said base member;

a substantially flat forwardly and downwardly slanting set support arranged at a first level at the top area of said column for supporting the posterior of a stool user;

a substantially flat shin support spaced from and disposed at a second level below and forward of said seat support, and slanting in the opposite direction thereof rearwardly and downwardly;

means for interconnecting said seat support and shin support to allow for said spaced relationship, so that the user with his posterior resting on the seat support can assume a kneeling-like posture to distribute the body weight by resting the shines of his legs on said shin support, thereby permitting a natural, kneeling-like posture of balance with a substantially vertical position of the torso;

the seat and shin support interconnecting means including an elongated frame member, the frame member having a first end and a second end opposite the first end, the shin support being mounted on the frame member in proximity to the first end thereof, the seat support being mounted on the frame member in proximity to the second end thereof, and the frame member being rotatably mounted to the vertical supporting column; and means mounting said seat support for simultaneous adjustment of the height of said seat and shin supports relative to said base member, said seat support being mounted so that said column is substantially forward of the center of said seat support.

2. A chair as defined by claim 1, wherein the interconnecting means further includes a first transverse member mounted transversely on the frame member and interposed between the frame member and the shin support, and a second transverse member mounted transversely on the frame member and interposed between the frame member and the seat support, and further comprises first and second resilient means interposed between at least one of the transverse members and the respective support.

3. A chair as defined by claim 1, wherein the shin support includes an edge having a recess formed therein, the frame member being at least partially received by the recess.

4. A chair as defined by claim 1, wherein the frame member has a generally S-shaped configuration.

5. A chair as defined by claim 1, wherein the height adjusting means includes a lifting/lowering mechanism disposed within in the vertical supporting column, and a release lever disposed below the seat support and operatively coupled to the lifting/lowering mechanism.

6. A chair as defined in claim 1, characterized in that said seat support is inclined by up to 20° relative to a first horizontal level, and that said shin support is inclined by up to 45° relative to a second horizontal level, said inclinations being opposite to each other.

7. Chair as defined in claim 1, characterized in that said shin support approximately 30 cm forward of said seat support.

8. Chair as defined in claim 1, characterized in that the spatial relationship between said seat support and said shin support in relation to a vertical plane is from slightly overlapping to a difference of 0–5 cm.

9. Chair as defined in claim 1, characterized in that the interconnecting means of said shin and seat supports comprise means for adjusting the distance between said supports.

10. Chair as defined in claim 9, characterized in that said adjusting means comprise two members held together by friction means, a first member representing an upper part of said interconnecting means and including a rotatable friction knob to be tightened for creating a friction force, and a second member representing a lower displaceable part to be loosened by said friction knob when untightening the same.

11. Chair as defined in claim 10, characterized in that said friction knob is located at the front of said upper part of said interconnecting means and extends rearwardly through a slit in said upper part of said interconnecting means, the length of the slit defining the distance the shin support can be adjusted relative to said seat support.

12. Chair as defined in claim 11, characterized by a first guiding pin extending from said lower part through said slit and protruding therefrom to mount said friction knob, and by a second guiding pin also extending from said lower part and through said slot but at a given distance from said first guiding pin.

13. Chair as defined in claim 9, characterized in that said adjacent means comprise a first upper pipe-shaped member representing a upper part of said interconnecting means, in which upper pipe-shaped member there is arranged a lower pipe-shaped member for telescopic displacement allowing for said adjustment between said shin and seat support, the displacement of said lower member being regulated by friction means arranged between said pipe-shaped members.

14. Chair as defined in claim 13, characterized in that said inner lower pipe-shaped member is provided with a longitudinally extending slit into which a transversely extending combined guiding and friction promoting pin extends, said pin at its first end protruding through the adjacent wall of said outer member for carrying a knob which upon rotation displaces the pin in a first or second transverse direction, for thereby promoting or releasing the friction force between said upper and lower members.

15. Chair as defined in claim 14, characterized in that the combined guiding and friction pin upon rotation of the knob in a friction promoting direction is pressed against the inner wall of the lower pipe-shaped member for pressing said wall against a friction pad arranged between the outer wall of said lower pipe-shaped member and the inner wall of said pipe-shaped upper member housing said lower member.

16. Chair as defined in claim 15, characterized in that the upper pipe-shaped member has a substantially rectangular hollow section, whereas the lower pipe-shaped member housed therein has a substantially round or oval hollow section, which in the area where said friction pin abuts the inner wall of said lower pipe-shaped member, comprises an inwardly bulging zone.

17. A chair adapted to support a person occupying the chair in a kneeling-like, sitting position, which comprises:

seat support being mounted so that said column is substantially forward of the center of said seat support.

18. A chair as defined by claim 17, wherein the frame member has a generally S-shaped configuration.

19. A chair as defined by claim 17, wherein the height adjusting means includes a lifting/lowering mechanism disposed within in the vertical supporting column, and a release lever disposed below the seat support and operatively coupled to the lifting/lowering mechanism.

* * * * *

UNITED STATES PATENT AND TRADEMARK OFFICE

CERTIFICATE OF CORRECTION

PATENT NO. : 4,960,305

DATED : October 2, 1990

INVENTOR(S) : Peter Opsvik

It is certified that error appears in the above-identified patent and that said Letters Patent is hereby corrected as shown below:

On the title page, in the title of the invention, before "COMPRISING," delete "AIR" and substitute therefor -- CHAIR __.

Signed and Sealed this

Seventeenth Day of March, 1992

*Attest:*

HARRY F. MANBECK, JR.

*Attesting Officer*

*Commissioner of Patents and Trademarks*